US008302537B2

(12) United States Patent
Quattlebaum

(10) Patent No.: US 8,302,537 B2
(45) Date of Patent: Nov. 6, 2012

(54) SELF-DRIVEN CABLE TRANSPORTATION SYSTEM FOR PERSONS USED FOR THE (AERIAL) OBSERVATION OF THE ENVIRONMENT

(75) Inventor: Gordon Thomas Quattlebaum, Ciudad Chemuyil (MX)

(73) Assignee: Eco Adventure Technologies, LLC, Garland, TX (US)

( * ) Notice: Subject to any disclaimer, the term of this patent is extended or adjusted under 35 U.S.C. 154(b) by 0 days.

(21) Appl. No.: 13/049,665

(22) Filed: Mar. 16, 2011

(65) Prior Publication Data

US 2011/0162551 A1 Jul. 7, 2011

Related U.S. Application Data

(63) Continuation of application No. 12/037,616, filed on Feb. 26, 2008, now abandoned.

(30) Foreign Application Priority Data

Feb. 27, 2007 (MX) ..... MX/e/2007/013901

(51) Int. Cl.
*B61B 7/00* (2006.01)

(52) U.S. Cl. ..... 104/112; 104/173.1; 104/96

(58) Field of Classification Search ..... 104/112, 104/113, 115, 173.1; 105/26.1, 91, 92, 95
See application file for complete search history.

(56) References Cited

U.S. PATENT DOCUMENTS

| | | | | | |
|---|---|---|---|---|---|
| 225,585 | A | | 3/1880 | Fox | |
| 547,528 | A | * | 10/1895 | Weaver et al. | 105/91 |
| 563,793 | A | * | 7/1896 | Nickerson | 104/93 |
| 575,528 | A | * | 1/1897 | Smallwood | 104/87 |
| 599,697 | A | * | 3/1898 | Foster | 105/91 |
| 639,240 | A | * | 12/1899 | Hutchinson | 104/115 |
| 1,087,062 | A | * | 2/1914 | Izett | 104/115 |
| 1,087,063 | A | * | 2/1914 | Izett | 104/115 |
| 1,206,581 | A | * | 11/1916 | Opsal | 104/115 |
| 3,192,872 | A | | 7/1965 | Parent | |
| 4,163,480 | A | * | 8/1979 | Highland | 182/14 |
| 4,428,576 | A | * | 1/1984 | Fisher, Jr. | 472/22 |
| 5,113,768 | A | * | 5/1992 | Brown | 104/112 |
| 5,178,593 | A | * | 1/1993 | Roberts | 482/62 |
| 5,224,426 | A | * | 7/1993 | Rodnunsky et al. | 104/112 |
| 5,378,214 | A | * | 1/1995 | Kreitenberg | 482/57 |
| 5,456,182 | A | | 10/1995 | Avraham | |

(Continued)

FOREIGN PATENT DOCUMENTS

CN 1129652 A 8/1996

(Continued)

*Primary Examiner* — Jason C Smith
(74) *Attorney, Agent, or Firm* — Arent Fox LLP

(57) ABSTRACT

A cable transportation system includes a first cable suspended over a ground surface, a vehicle supported above the ground surface by the first cable, wherein the vehicle has one or more grooved wheels for riding along the first cable, a frame supported from above by the one or more grooved wheels, and at least one vehicle guide that extends below the grooved wheels, and a junction bracket that has a ramped section, a mid portion section connected to the ramp section, and a rail portion provided on both the ramped section and the mid portion section, wherein the junction bracket is connected to the first cable so that at least an end portion of the ramped section is parallel to and directly above the first cable and the grooved wheels transition from the first cable onto the rail portion when the vehicle engages the junction bracket.

19 Claims, 12 Drawing Sheets

U.S. PATENT DOCUMENTS

| | | | | |
|---|---|---|---|---|
| 5,904,638 | A * | 5/1999 | Habing et al. | 482/57 |
| 6,427,601 | B2 * | 8/2002 | Albrich | 104/87 |
| 8,042,474 | B2 * | 10/2011 | Perakis | 104/112 |
| 2008/0202375 | A1 * | 8/2008 | Quattlebaum | 104/112 |
| 2008/0229967 | A1 * | 9/2008 | Lins et al. | 104/173.1 |
| 2010/0107919 | A1 * | 5/2010 | Perakis | 104/112 |
| 2010/0147180 | A1 * | 6/2010 | Perry | 104/112 |
| 2011/0083577 | A1 * | 4/2011 | Tilley | 104/96 |
| 2011/0162551 | A1 * | 7/2011 | Quattlebaum | 104/112 |

FOREIGN PATENT DOCUMENTS

| | | | |
|---|---|---|---|
| CN | 2619848 | Y | 6/2004 |
| EP | 0 705 749 | A1 | 4/1996 |
| EP | 705749 | A1 * | 4/1996 |
| ES | 292 299 | A1 | 1/1964 |
| GB | 2 348 407 | A | 10/2000 |
| GB | 2348407 | A * | 10/2000 |
| JP | 9-315298 | A | 12/1997 |
| JP | 2002-178912 | A | 6/2002 |

* cited by examiner

SELF-DRIVEN CABLE TRANSPORTATION SYSTEM FOR PERSONS USED FOR THE (AERIAL) OBSERVATION OF THE ENVIRONMENT

CROSS REFERENCE TO RELATED APPLICATION

This application is a Continuation-in-Part application of pending U.S. patent application Ser. No. 12/037,616, filed Feb. 26, 2008, which claims the benefit of Mexican Patent Application Nos. MX/a/2007/002349 and MX/E/2007/013901, filed on Feb. 27, 2007, the entire specification, claims and drawings of which are incorporated herewith by reference.

FIELD OF THE INVENTION

The technical field of the invention is generally that of vehicles, devices, structures and installations used for the transportation of persons by cable, wherein the vehicles may be self-driven and serve to observe the scenery of an environment in a recreational and/or scientific way.

DESCRIPTION OF THE RELATED ART

There are different ways to make aerial panoramic observations of the environment for recreational and/or scientific purposes. However, most involve very costly and sophisticated mechanical equipment, e.g., airplanes, helicopters, cableways, lift-cars, and the intervention of highly trained third parties who are dedicated to operate the equipment, limiting the use to very few individuals.

There are different cable transportation systems for people. However, the great majority of these systems are not self-driven and require special rails or lanes so that the cost of installation, maintenance and operation, increases.

There are cheaper systems that use cables set at an angle so there is a level difference between the starting and ending points, through which the user slides using weight and gravity as the driving force. In such a system, the user hangs from the cable through a pulley to which he is attached using straps, hooks and a harness. These methods are inconvenient as they can only be used one way (downwards), there is no real control of the speed, nor is it possible to stop at a desired point to make detailed observations. In addition, the user must stop at the points of cable anchorage, which must be fitted with a platform, and the user must remove his weight from the cable, separate from the pulley and/or cable, and re-attach again to the same cable after the anchorage in order to continue in a descending tour.

In some cases, the same system is used in level stretches wherein the user pulls along the cable with his arms, which is not very practical for at least the reason that the user is using his arms to provide the driving force instead of having them available to hold binoculars to observe the environment, or take notes or pictures, for example, in addition to the fact that the arms of most users tend to tire quickly, so the level stretch must be very short.

The present application is directed to the design and operation of a cable transportation system for persons that allows for the aerial panoramic observation over any type of terrain, that is easy and inexpensive to build and maintain, and which will allow, in addition, a user with no prior training or specialized equipment to use the system.

SUMMARY

Aspects of the present invention are directed to a cable transportation system that includes a first cable suspended over a ground surface, a vehicle supported above the ground surface by the first cable, wherein the vehicle has one or more grooved wheels for riding along the first cable, a frame supported from above by the one or more grooved wheels, at least one vehicle guide that extends below the grooved wheels, and a junction bracket that has a ramped section, a mid portion section connected to the ramp section, and a rail portion provided on both the ramped section and the mid portion section, wherein the junction bracket is connected to the first cable so that at least an end portion of the ramped section is parallel to and directly above the first cable and the grooved wheels transition from the first cable onto the rail portion when the vehicle engages the junction bracket.

In another aspect according to the present invention, the mid portion section of the junction bracket is formed to raise the vehicle a predetermined height above the first cable so the vehicle guides pass above the first cable when the vehicle travels onto the junction bracket.

In yet another aspect according to the present invention, the cable transportation system may include a second cable, wherein the junction bracket further comprises a down ramp section, the rail portion extends from the mid portion section to the down ramp section, and the junction bracket is connected to the second cable so that at least an end portion of the down ramp section is parallel to and directly above the second cable so that the grooved wheels of the vehicle transition from the rail portion onto the second cable when the vehicle disengages the junction bracket.

In addition, the mid portion section of the junction bracket may also include a hinged portion, wherein the down ramp section of the junction bracket may be selectively moved about a pivot point of the hinged portion to couple the junction bracket with more than one exit cable.

Furthermore, in accordance with yet other aspects of the present invention, a method of transporting a vehicle over a ground surface includes suspending a first cable over the ground surface, suspending a second cable over the ground surface, coupling the first cable to the second cable with a junction bracket, supporting a vehicle on the first cable via one or more grooved wheels, and driving the vehicle from the first cable to the second cable via the junction bracket.

Additional advantages and novel features of aspects of the invention will be set forth in part in the description that follows, and in part will become more apparent to those skilled in the art upon examination of the following or upon learning by practice of the invention.

DETAILED DESCRIPTION

Figure 1:
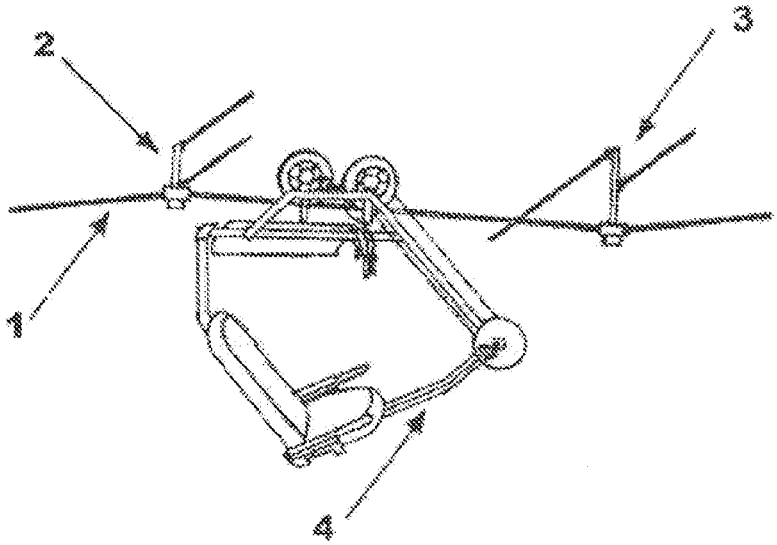
FIG. 1 is a general view of the self-driven cable transportation system for persons used for the aerial panoramic observation of the environment, in accordance with certain aspects of the present invention.

Various aspects of a cable transportation system may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Relative terms such as "lower" or "bottom" and "upper" or "top" may be used herein to describe one element's relationship to another element illustrated in the drawings. It will be understood that relative terms are intended to encompass different orientations of a cable transportation system in addition to the orientation depicted in the drawings. By way of example, if aspects of a cable transportation system shown in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

Various aspects of a cable transportation system may be illustrated with reference to one or more exemplary implementations. As used herein, the term "exemplary" means "serving as an example, instance, or illustration," and should not necessarily be construed as preferred or advantageous over other variations of the devices, systems, or methods disclosed herein.

A self-driven cable transportation system for persons used for the aerial panoramic observation of the environment described herein, will allow for the economic installation and operation of suspended cable through rough terrain like mountains, jungles, ravines, rivers, forests, etc., with which a great number of people will be able to make observations, perform investigation and take pictures of the environment from an aerial panoramic perspective in a safe and comfortable manner, without requiring any prior training and/or the use of costly mechanized equipment.

The system includes at least one cable suspended over the ground using special brackets over which a vehicle, which may be driven by a user, moves about in a safe and controlled manner in order to observe the environment and transport the user or cargo, for example, from one place to another without having to stop at the cable's anchoring points.

When propelled by a user, the user has full control of the vehicle's speed, being able to accelerate, break and stop at will, having at all times both hands free to be able to take notes, snapshots, etc.

As shown in FIG. 1, the self-driven cable transportation system for persons used for the aerial panoramic observation of the environment includes a cable 1, which allows the user to be transported over any type of ground while being suspended. The journey, extension, level gradient and the way of setting the route will vary according to the design of the system's path and the different variables of the ground over which it will be installed. The system may be configured with a cable 1, preferably of steel, which is run along the route of a desired path using brackets which support and provide tension to the cable 1. A variety of brackets may be used to support and tension the cable. As shown in FIG. 1, for example, one possible configuration includes two types of brackets: a side-support bracket 2 and an opposed-support bracket 3, which may be fixed to any natural element available like trees, rocks, etc., or, if necessary, to any type of artificial element, such as poles, towers, constructions, etc. The brackets 2 and 3 allow the system's vehicle 4 to run freely along the route without need for stopping or making transfers in the places of the cable anchoring.

The cable 1 may be installed over a ground surface, for example, using the brackets 2 and 3. Several vehicles 4 may be mounted onto the cable 1 at the same time, the number being limited according to a resistance of the natural or artificial elements to which the brackets have been fixed and support specifications of the materials used in the construction of same.

Figure 2:
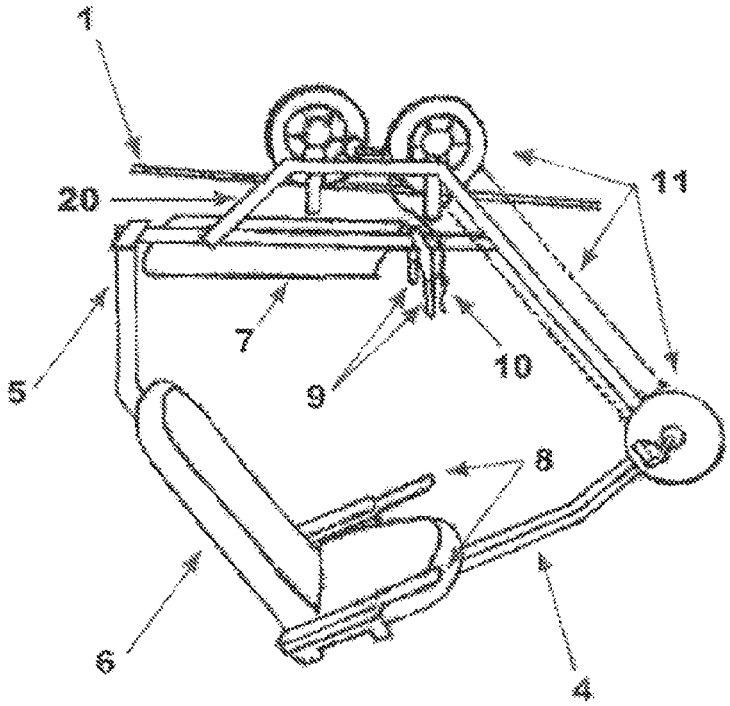
FIG. 2 is a detailed view of the vehicle of the self-driven cable transportation system for persons used for the aerial panoramic observation of the environment, in accordance with certain aspects of the present invention.

In accordance with certain aspects of the present invention, as shown in FIG. 2, the vehicle 4, may require the user to mechanically drive the vehicle along the cable 1 using a pedaling motion of the legs, for example. The vehicle 4 may include a rigid frame 5 composed of metal or any other suitable material, a hook-shaped arm 20 attached to a top portion of the frame 5 and made of the same material as the frame 5, and a seat 6, which may include a backrest and wherein the user may sit comfortably in a reclined position. The seat 6 may be adjusted by sliding and locking the seat 6 horizontally and vertically within the frame 5 of the vehicle in order to accommodate users of varying sizes. The seat 6 may include safety straps to fasten the user to the vehicle 4 and avoid accidental falls. A suitable covering 7 may be provided to protect the user against possible overhead impacts or from the rain and the sun, in addition to forming a barrier to avoid accidental contact of the user's head or hands with the cable and the grooved wheels 13 (see FIG. 3). The covering 7 may have different shapes and be made of different materials. One or more grip bars may be provided for the user. A lower grip bar 8 may be provided at a location near the seat 6 and/or an upper grip bar 9 may be provided fixed to an upper portion of the frame 5. One or more braking levers 10 may be mounted to one or both of the grip bars 8 and 9. The user may hold the grip bars 8 and/or 9 for stabilization, comfort, and/or to brake the vehicle using the braking lever 10. A traction mechanism 11 may include pedals, sprockets, a chain and the grooved wheels 13. The traction mechanism 11 may be driven by the user's legs and feet, which provides the drive force to move the vehicle through the cable route. The pedals may have elements allowing them to be fixed to the user's feet, and a braking system installed at the grooved wheels 13 may be actuated by the braking lever 10 located on one or both of the grip bars 8 and 9.

Figure 3:
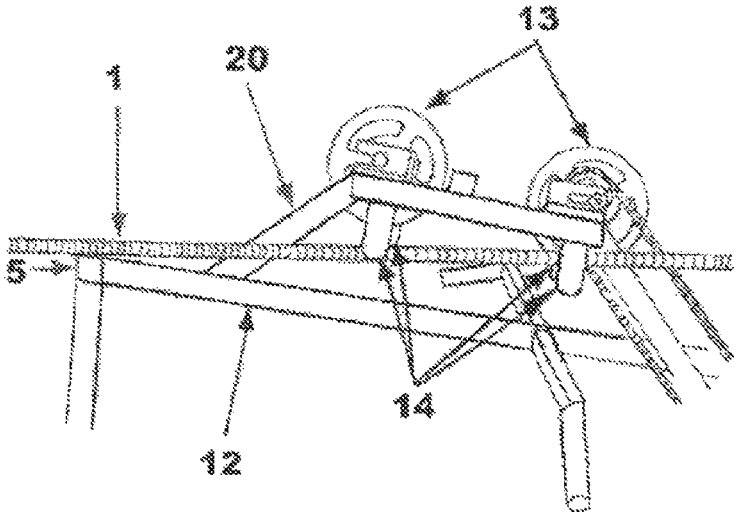
FIG. 3 is a detail view of the safety mechanism and the grooved wheels of the self-driven cable transportation vehicle system for persons used for the aerial panoramic observation of the environment, in accordance with certain aspects of the present invention.

The vehicle 4 hangs from the cable line 1 through the hook-shaped arm 20, where the grooved wheels 13, vehicle guides 14, and the vehicle frame 5 form a safety system to keep the vehicle 4 from dislodging from the cable line 1 while in use. However, the versatile safety system allows the vehicle to be easily removed from the cable 1 when the vehicle is not in use. In order to remove the vehicle, the vehicle may be lifted in order to maintain the vehicle in a parallel position to the cable 1 so that the vehicle may be pushed forward a few centimeters to release the vehicle from the cable 1. As shown in FIG. 3, the vehicle 4 may be released as such due to the open side 12 of the frame and precise distances between the grooved wheels 13, the vehicle guides 14, and the vehicle's frame 5. Concurrently, the configuration of the vehicle 4 allows it to run freely through the brackets 2 and 3 and, in case of the grooved wheels 13 jumping out of the grooves, the angle created by the vehicle with respect to the cable 1 is sufficient for the vehicle, assisted by gravity, to seize and/or lock to the cable.

The vehicle displaces along the cable by means of the grooved wheels 13, preferably having a rolling surface lined in rubber. One of the grooved wheels 13 may be a drive wheel, which provides the traction for the vehicle 4 by being directly coupled to the chain and sprocket traction mechanism 11 driven by the user's feet. Although described herein as being driven by a user's feet, the traction mechanism 11 driven may alternatively be driven through the mechanical motion of a user's arms, and/or may be driven by an electric motor, for example.

Figure 4:
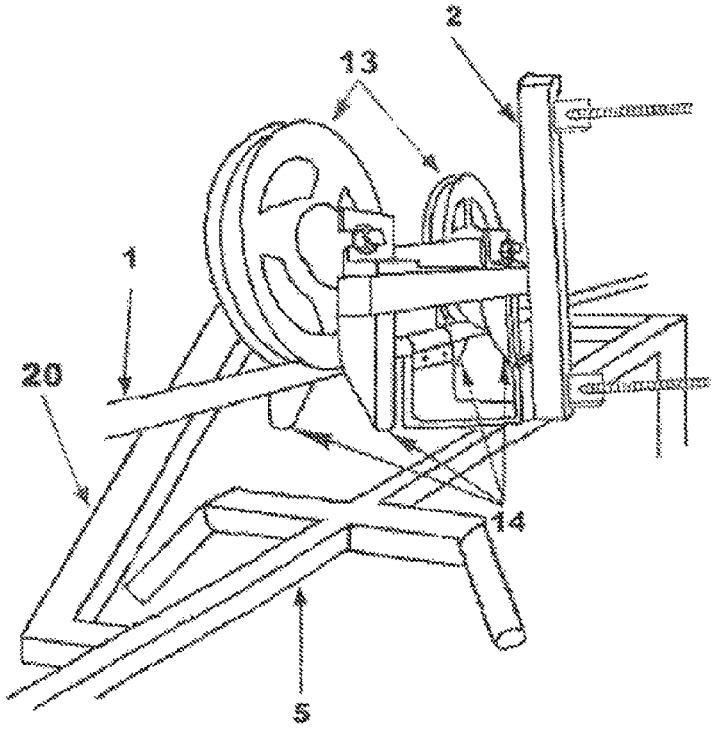
FIG. 4 is a detail view of the mechanism to mount the self-driven cable transportation vehicle system for persons used for the aerial panoramic observation of the environment, in accordance with certain aspects of the present invention.

As shown in FIG. 4, the vehicle guides 14 may be "V" shaped and provided to extend along each side of the grooved wheels beyond a bottom contact portion of the grooved wheels 13 with the cable 1. The vehicle guides 14 efficiently align the grooved wheels 13 of the vehicle with the cable 1 while preventing the vehicle from jumping out of track. By forming a "V", the vehicle guides 14 allow the vehicle to keep the optimal alignment with the cable without the use of moving parts, while allowing free passage of the vehicle through the brackets 2 and 3.

Figure 5:
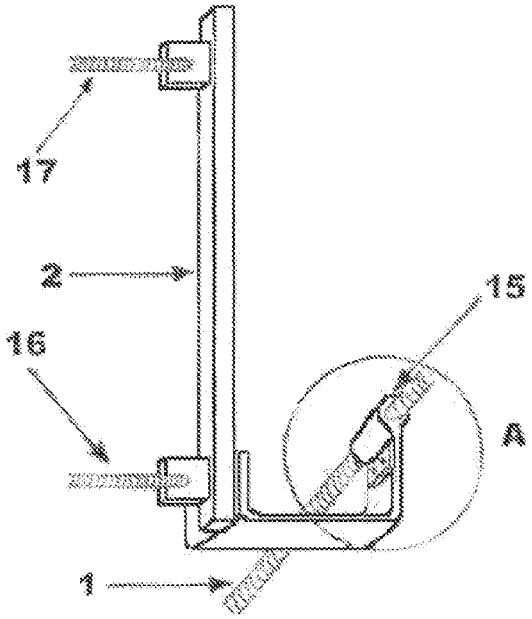
FIG. 5 is a front perspective view of the side-support bracket, in accordance with certain aspects of the present invention.
Figure 6:
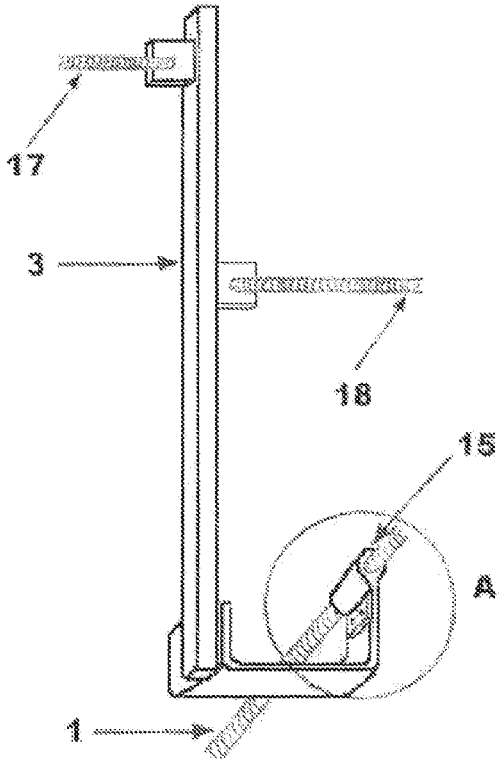
FIG. 6 is a front perspective view of the opposed support bracket, in accordance with certain aspects of the present invention.

As shown in FIGS. 5 and 6, the brackets 2 and 3 may be "L" shaped brackets, supporting and providing tension to the cable route 1. The brackets 2 and 3 may be comprised of a rigid material strong enough to support a predetermined weight of the cable and vehicles, such as welded metal, for example. The brackets 2 and 3 may include a lower open side having a ledge and a tab coupling flange 15 to support the cable 1. The brackets 2 and 3 may be fixed by means of two cables to any type of natural element available like trees, rocks, etc., or if necessary, to any type of artificial element, such as poles, towers, constructions, etc.

As shown in FIG. 5, the bracket 2 may be configured to be connected to a tensor cable 16 and to a positioning cable 17 along its closed side, the closed side being on an outer part of the long side of the "L" opposite the coupling flange 15. By pulling the lateral tensor cable 16, the cable 1 may be pulled toward the closed side of the bracket 2, making the cable route turn in that direction. Once the cable 1 has been fixed by the lateral tensor cable 16, the positioning cable 17 allows adjustment of the bracket 2 to maintain the bracket in a substantially vertical position, allowing efficient passage of the vehicle 4 past the bracket 2.

As shown in FIG. 6, the opposed support bracket 3 may be connected using an opposed tensor cable 18 at the open side of the bracket 3, i.e., an internal side of the long side of the "L" closest to the coupling flange 15. The positioning cable 17 may be connected to the closed side of the bracket 3, i.e., the external part of the long side of the "L". By pulling the opposed tensor cable 18, the cable 1 may be pulled toward the open side of the bracket 2, making the cable route turn in that direction. Once said cable is fixed, the positioning cable 17 is adjusted to position the bracket 3 so that it remains straight, thus allowing passage of the vehicle 4.

Figure 7:
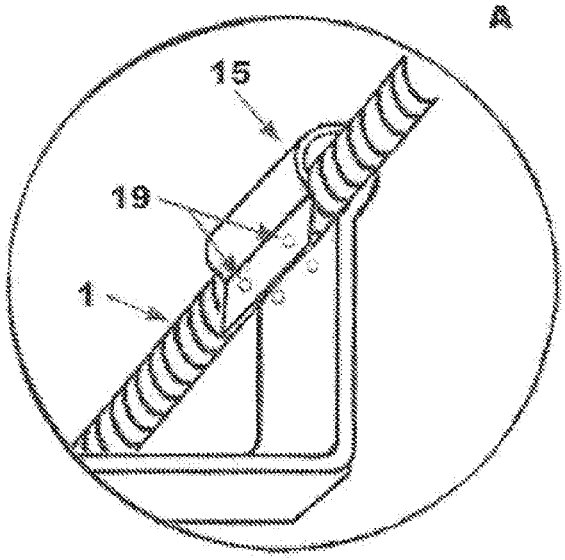
FIG. 7 is a detail of (A) showing the tab coupling flange for the cable used in the brackets, in accordance with certain aspects of the present invention.

As shown in FIG. 7, the brackets 2 and 3 have a ledge with a tab coupling flange 15 along the open side for supporting cable 1. The coupling flange 15 surrounds the cable 1 and fixes the cable 1 to the bracket with screws 19. The tab coupling flange 15 allows for the brackets 2 and 3 to be installed and removed from cable 1 easily and quickly, making it possible to maintain and repair the cable route in an efficient and economic manner.

The brackets, the safety mechanism, and the mechanism for proper hanging of the vehicle are designed in such a way to allow the vehicle to displace safely and continuously along the cable. The brackets 2 and 3 support the cable on a side, allowing the vehicle to pass. The mechanism to ensure proper hanging passes above the bracket, while the vehicle frame passes below the same.

The brackets 2 and 3 may be provided to configure the cable 1 with turns that change the direction of travel in the range of 10-15 degrees. However, in accordance with yet another aspect of the present invention, as shown in FIGS. 8-12, the cable transportation system may include a junction bracket 50 that allows the vehicle 4 to turn up to ninety degrees (90°) in as short of a distance as five feet, for example. In addition, the junction bracket 50 may permit a vehicle 4 to change from one cable to another cable without stopping or lifting the vehicle 4.

Figure 8:
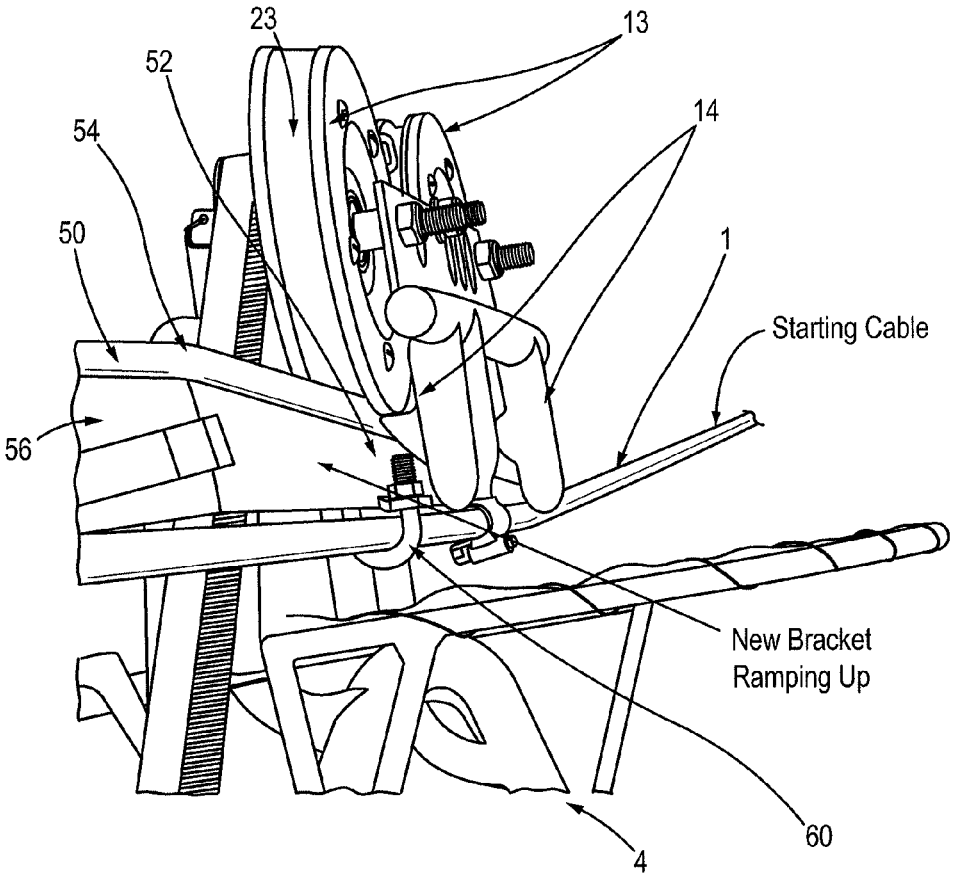
FIG. 8 is a perspective view of aspects of a junction bracket used in a cable transportation system, in accordance with certain aspects of the present invention.

As shown in FIG. 8, the vehicle 4 may be traveling along the cable 1, which may be a starting cable, for example. The junction bracket 50 may be mounted directly onto the cable 1 by connection devices 60, such as U-bolt connectors, for example, so that a ramped section 52 of the junction bracket lines up in parallel and directly above the cable 1. The bracket includes a round rail portion 54 that approximates the diametrical dimensions of the cable 1. The ramped section 52 of the junction bracket 50 provides a smooth transition for the grooved wheels 13 of the vehicle 4 to ride up onto the ramp section 52 of the junction bracket 50. The grooves 23 in the grooved wheels 13 ride seamlessly from the cable 1 onto the round rail portion 54 of the junction bracket 50.

Figure 9:
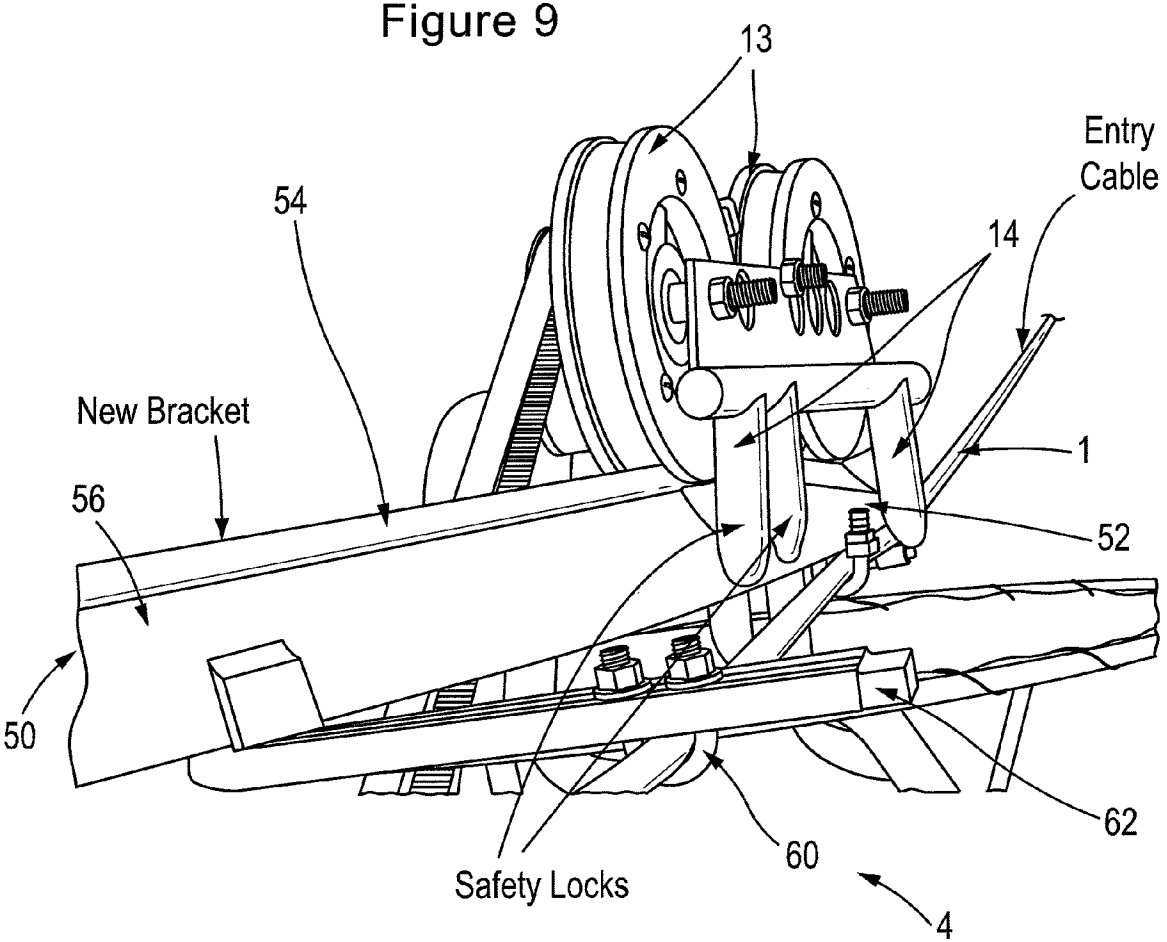
FIG. 9 is a perspective view of aspects of a junction bracket used in cable transportation system, in accordance with certain aspects of the present invention.
Figure 10:
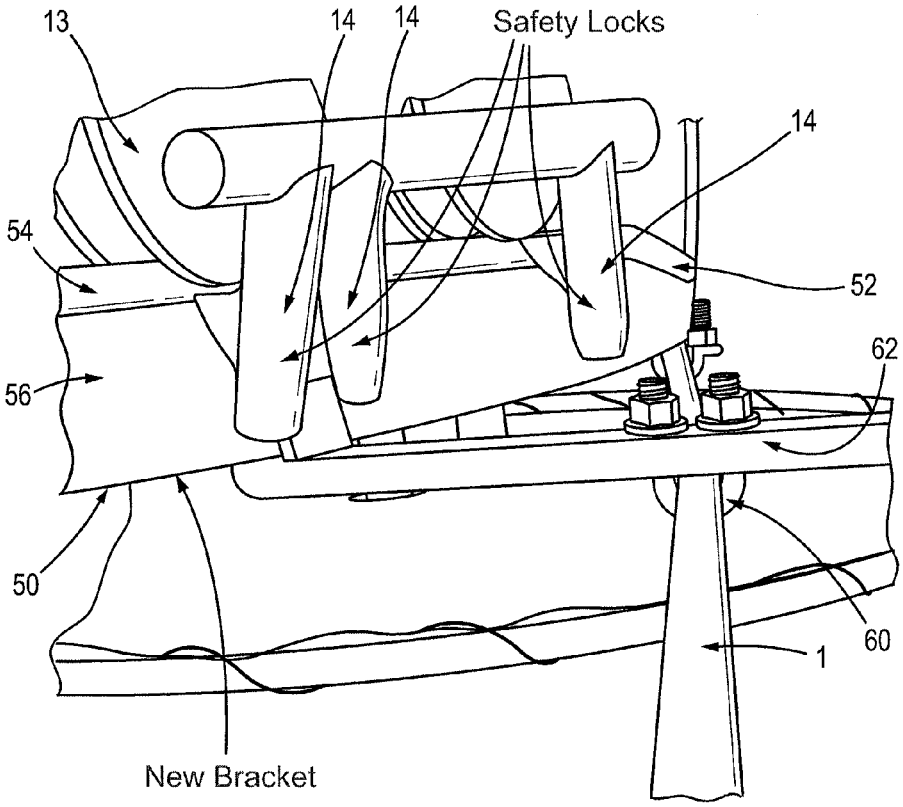
FIG. 10 is a perspective view of aspects of a junction bracket used in cable transportation system, in accordance with certain aspects of the present invention.
Figure 11:
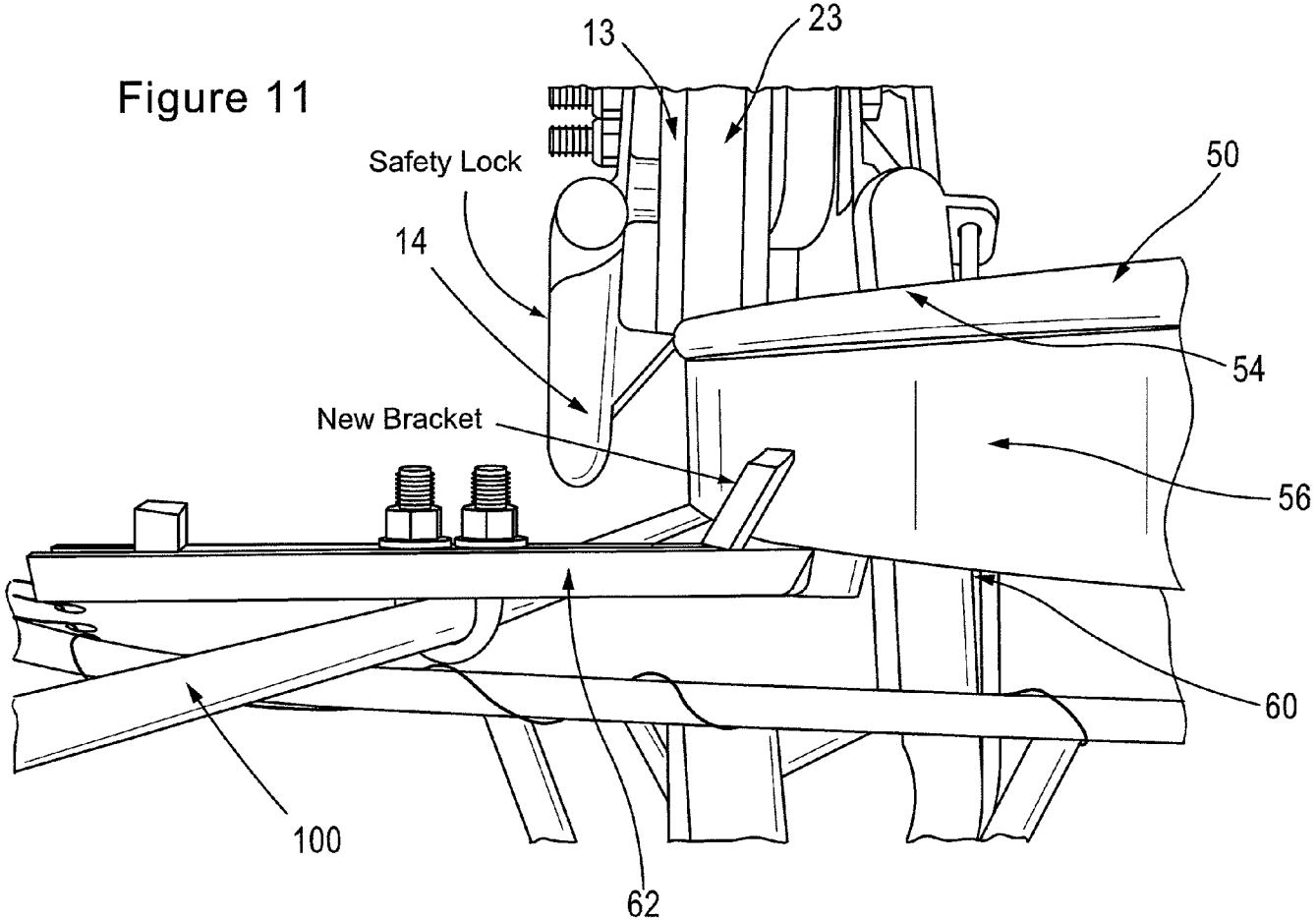
FIG. 11 is a perspective view of aspects of a junction bracket used in cable transportation system, in accordance with certain aspects of the present invention.

As shown in FIGS. 9 and 10, the ramped section 52 of the junction bracket 50 rises to meet a mid portion section 56 of the junction bracket 50. The mid portion section 56 is formed to raise the vehicle 4 a predetermined height above the cable 1 so that the vehicle guides 14 may pass safely above the cable 1. Thus, the mid portion 56 of the junction bracket 50 may be formed to curve away from the cable 1 and the vehicle 4 is free to disengage from and pass over the cable 1 without the vehicle guides 14 catching on the cable 1. With the grooved wheels 13 now riding on the round rail portion 54, the vehicle is safely locked onto the junction bracket 50. As shown in FIGS. 9-11, when the vehicle rides on the junction bracket 50, the vehicle guides 14 extend down below the round rail portion 54 of the junction bracket 50 to prevent the vehicle 4 from dislodging from the junction bracket 50 in the same way the vehicle guides 14 prevent the vehicle 4 from dislodging from the cable 1. Lateral members 62 may be provided for additional mounting support for the junction bracket 50. As shown in FIG. 9, the lateral member 62 may be integrally fixed to the junction bracket 50 and connected to the cable 1 by a connection device 60. The junction bracket 50 may be free floating between two cables, e.g., cable 1 and an exit cable 100 (see FIG. 11), or one or more lateral members 62 may be directly coupled to natural and/or man-made supports for substantially supporting the junction bracket 50 in a fixed position.

Figure 12:
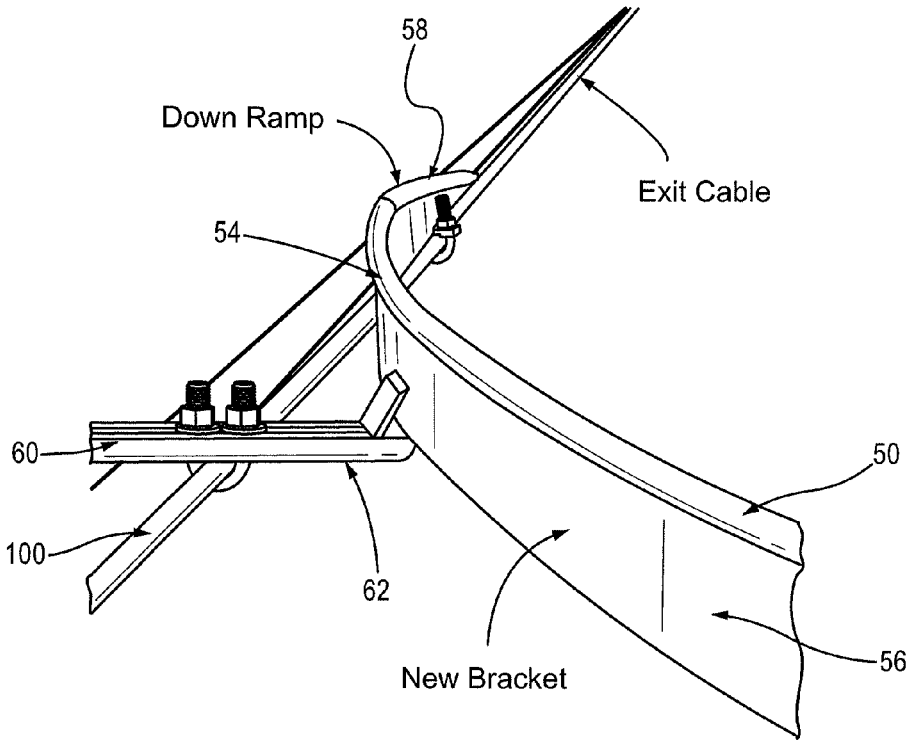
FIG. 12 is a perspective view of aspects of a junction bracket used in cable transportation system, in accordance with certain aspects of the present invention.

As described above with respect to the cable 1, the junction bracket 50 may also be coupled to an exit cable 100, having the same diametrical dimension as the cable 1. As shown in FIG. 12, the mid portion section 56 connects the ramped section 52 to a down ramp section 58. The down ramp section 58 of the junction bracket 50 is thus formed and mounted to the exit cable 100 so that the round rail portion 54 slopes down to meet the exit cable 100 with the down ramp section 58 being parallel and in line with the exit cable 100. The down ramp section 58 may be provided with the same round rail portion 54 that extends along the mid portion section 56 and the ramped section 52. The grooves 23 in the grooved wheels 13 roll down the slope of the down ramp section 58 and onto the exit cable 100. As the vehicle 4 travels from the junction bracket 50 onto the exit cable 100, the vehicle guides 14 extend below the exit cable 100 to lock the vehicle 4 safely onto the exit cable 100.

The junction bracket 50 allows a user, for example, to remain in the vehicle 4 while making sharp turns and/or transferring to a different cable. By permitting the transfer to different cables, the cable transportation system may be set up with multiple anchor points and/or shorter cable runs without impacting the overall desired length of a course. In addition, a cable course may be established to easily loop around so that vehicles do not have to be removed from an end portion of the course and set back on a beginning portion of the course.

In another aspect of the present invention, the junction bracket 50 may be formed to have a hinged section at a point along the mid portion section 56. In this manner, the down ramp section 58 of the junction bracket 50 may be selectively moved about a pivot point to effectively couple the junction bracket 50 to one of multiple exit cables, thus allowing the junction bracket 50 to be used much like a railway switch, permitting multiple cable routes to extend from one incoming cable line, for example. Accordingly, a complex of interconnecting cables may be used to provide transportation to multiple locations at the discretion of the user.

The previous description is provided to enable any person skilled in the art to practice the various exemplary implementations described herein. Various modifications to these variations will be readily apparent to those skilled in the art, and the generic principles defined herein may be applied to other implementations. All structural and functional equivalents to the elements of the various illustrious examples described throughout this disclosure that are known or later come to be known to those of ordinary skill in the art are expressly incorporated herein by reference.

What is claimed is:

1. A cable transportation system comprising:

a first cable suspended over a ground surface;

a vehicle supported above the ground surface by the first cable, the vehicle comprising:

one or more grooved wheels for riding along the first cable;

a frame supported from above by the one or more grooved wheels; and at least one vehicle guide that extends below the grooved wheels on a side of the first cable opposite from the frame; and a junction bracket comprising:

a ramped section;

a mid portion section connected to the ramp section; and a rail portion provided on both the ramped section and the mid portion section;

wherein the junction bracket is connected to the first cable so that at least an end portion of the ramped section is parallel to and directly above the first cable so that the one or more grooved wheels transition from the first cable onto the rail portion when the vehicle engages the junction bracket.

2. The cable transportation system of claim 1, further comprising a bracket, wherein the bracket is fixed to a natural or artificial structure and supports the first cable by lateral extension of a tensor cable and a positioning cable.

3. The cable transportation system of claim 2, wherein the tensor cable provides lateral support and tensing of the first cable while the positioning cable maintains an upper part of the bracket in a position relatively perpendicular to the ground surface to allow unobstructed passage of the vehicle.

4. The cable transportation system of claim 1, wherein the vehicle further comprises:

a seat; and a drive mechanism connected the one or more grooved wheels for driving the vehicle over the first cable and the junction bracket.

5. The cable transportation system of claim 4, wherein the vehicle further comprises at least a pair of pedals, and the drive mechanism is a user applying force to the pair of pedals.

6. The cable transportation system of claim 1, wherein the mid portion section is formed to raise the vehicle to a predetermined height above the first cable so the vehicle guides pass above the first cable when the vehicle travels onto the junction bracket.

7. The cable transportation system of claim 6, wherein the junction bracket is formed to curve away from the first cable.

8. The cable transportation system of claim 6, wherein the vehicle guides extend below the rail portion.

9. The cable transportation system of claim 6, further comprising a second cable, wherein the junction bracket further comprises a down ramp section, the rail portion extends from the mid portion section to the down ramp section, and the junction bracket is connected to the second cable so that at least an end portion of the down ramp section is parallel to and directly above the second cable so that the grooved wheels transition from the rail portion onto the second cable when the vehicle disengages the junction bracket.

10. The cable transportation system of claim 9, wherein the mid portion section of the junction bracket further comprises a hinged portion, and wherein the down ramp section of the junction bracket may be selectively moved about a pivot point of the hinged portion to couple the junction bracket with more than one exit cable.

11. The cable transportation system of claim 1, wherein the at least one vehicle guide comprises a free end free from contacting the frame.

12. A method of transporting a vehicle over a ground surface comprising:

suspending a first cable over the ground surface;

suspending a second cable over the ground surface;

coupling the first cable to the second cable with a junction bracket, the junction bracket having a ramped section;

supporting a vehicle on the first cable via one or more grooved wheels;

transitioning the one or more grooved wheels from the first cable to the junction bracket via the ramped section; and transitioning the one or more grooved wheels from the junction bracket to the second cable.

13. The method of transporting a vehicle of claim 12, further comprising:

fixing a bracket to a natural or artificial structure by lateral extension of a tensor cable and a positioning cable to support the first cable.

14. The method of transporting a vehicle of claim 12, further comprising:

fixing a second bracket to a natural or artificial structure by lateral extension of a second tensor cable and a second positioning cable to support the second cable.

15. The method of transporting a vehicle of claim 12, further comprising:

forming the junction bracket to have a rail section extending across the ramped section, a mid portion section, and a down ramp section.

16. The method of transporting a vehicle of claim 15, further comprising:

connecting the junction bracket to the first cable so that at least an end portion of the ramped section is parallel to and directly above the first cable and the grooved wheels transition from the first cable onto the rail portion when the vehicle engages the junction bracket.

17. The method of transporting a vehicle of claim 16, further comprising:

forming the mid portion section of the junction bracket to raise the vehicle to a predetermined height above the first cable so vehicle guides provided on the vehicle pass above the first cable when the vehicle travels onto the junction bracket.

18. The method of transporting a vehicle of claim 17, further comprising:

connecting the junction bracket to the second cable so that at least an end portion of the down ramp section is parallel to and directly above the second cable so that the grooved wheels transition from the rail portion onto the second cable when the vehicle disengages the junction bracket.

19. The cable transportation system of claim 12, further comprising:

maintaining alignment of the vehicle with the first and second cables via at least one vehicle guide, wherein the at least one vehicle guide extends below the grooved wheels on a side of the first cable.

* * * * *